US006481502B1

(12) United States Patent
Heinke et al.

(10) Patent No.: US 6,481,502 B1
(45) Date of Patent: Nov. 19, 2002

(54) BOREHOLE CLOSURE PLUG

(76) Inventors: Nils Alberto Heinke, Rte. 1, Box 328-50, Elkins, WV (US) 26241; Roger Dean Skaggs, 7430 House Rd., Bonne Terre, MO (US) 63628; Stephen Mitchell Collinsworth, 839 Lower Hatchers Creek Rd., Stanton, KY (US) 40380

( * ) Notice: Subject to any disclaimer, the term of this patent is extended or adjusted under 35 U.S.C. 154(b) by 0 days.

(21) Appl. No.: 09/701,022

(22) PCT Filed: May 27, 1999

(86) PCT No.: PCT/IB99/00956

§ 371 (c)(1),
(2), (4) Date: Feb. 21, 2001

(87) PCT Pub. No.: WO99/61864

PCT Pub. Date: Dec. 2, 1999

(30) Foreign Application Priority Data

May 27, 1998 (ZA) ..... 98/4522

(51) Int. Cl.[7] ..... E21B 33/13
(52) U.S. Cl. ..... 166/292; 166/192
(58) Field of Search ..... 166/135, 192, 166/193, 202, 292, 383

(56) References Cited

U.S. PATENT DOCUMENTS 2,710,065 A * 6/1955 Hamilton, Jr. ..... 166/192
4,066,125 A * 1/1978 Bassani ..... 166/202
4,736,796 A * 4/1988 Arnall et al. ..... 166/292
5,479,986 A * 1/1996 Gano et al. ..... 166/292

* cited by examiner

*Primary Examiner*—William Neuder
(74) *Attorney, Agent, or Firm*—Rothwell, Figg, Ernst & Manbeck PC

(57) ABSTRACT

A plug for use in a borehole, the plug including a body member of a flexible material, the body member defining a floor portion, with a wall portion bounding and extending from the floor portion for engagement with an inner wall of the borehole for sealing the borehole. The invention also relates to a method of supporting materials in a borehole.

10 Claims, 3 Drawing Sheets

BOREHOLE CLOSURE PLUG

BACKGROUND OF THE INVENTION

1. Field of the Invention

THIS INVENTION relates to a plug for use in a borehole. More particularly, the invention relates to a plug for use in a borehole and to a method of supporting materials in a borehole.

2. Description of the Related Art

UK Patent No. 2,211,587 A discloses a constriction means for use in a vertical borehole which comprises a plastics bucket which is seated in a cylindrical wall gripping means. The wall gripping means is capable of lateral expansion to grip inner sides of the borehole so that the constriction means is prevented from moving inside the borehole.

According to the invention, there is provided a plug for use in a borehole, the plug including a body member of a flexible material, the body member defining a floor portion, with a wall portion bounding and extending from the floor portion for engagement with an inner wall of the borehole for sealing the borehole.

BRIEF SUMMARY OF THE INVENTION

Preferably, the body member is of a resiliently flexible material such as a suitable synthetic plastics material.

The plug may further include an attachment means carried by the body member for attaching a manipulating means to the body member to control its positioning within the borehole.

The body member may define a receptacle in which material to be supported is received, with the wall portion extending from the floor portion in a flared manner such that a rim of the wall portion bounds an opening having a greater area than that of the floor portion.

Further, one end of the wall portion may be lower than an opposed higher end, the lower end being a leading end and the higher end being a trailing end of the body member when it is inserted into the borehole, the body member defining an offset frusto-conical element so that an axis of the frusto-cone is at a predetermined angle to the vertical when the body member is lying on its rim.

The lower end and the higher end of the wall portion may each extend at an angle of between 90° to 130° to the floor portion.

The arrangement may be such that, when the body member rests on its floor portion, the lower end of the wall portion extends substantially vertically, or at a shallower angle to the vertical, than the higher end of the wall portion, which may flare outwardly from the floor portion at a predetermined angle to the vertical greater than that of the lower end. Instead, the lower end of the wall portion and the higher end of the wall portion may extend substantially parallel to each other such that, when the body member is viewed from the side, it is substantially trapezoidal and not frusto-conical.

At least one circumferential groove may be defined in the wall portion.

The attachment means may be carried on the wall portion at said leading end of the wall portion. The attachment means may be an opening defined in said leading end of the wall portion proximate a rim of the wall portion.

The plug may further include a manipulating means in the form of an elongate, filamentary element such as a length of string which is secured to the attachment means of the body member, the string being of a predetermined length for positioning the body member at a desired location, or depth, in the borehole.

The plug may yet further include a securing means for securing a free end of the length of string at an entrance opening or mouth of the borehole. The securing means may be in the form of an anchor which, in use, may be of a length dimension exceeding a diameter of the mouth of the borehole to overlie and rest on the substrate into which the borehole has been drilled.

The plug may also include a trailing end attachment means which is carried on the wall portion at said trailing end of the wall portion, with a recovery means in the form of a length of string being secured to the attachment means of the body member for recovery of the body member from the borehole.

In an alternative embodiment of the invention, the plug as claimed in claim 1, in which the floor portion is substantially planar.

The floor portion may have a thickness of between 0.5 mm and 30 mm.

To assist in deformation of the body member, in use, a wedge-shaped groove may be defined in the floor portion, the wedge-shaped groove increasing in depth from the leading end of the floor portion to the trailing end to impart a cloven hoof-shape to the body member, when viewed externally of the body member. Still further, the floor portion may be slightly dished to have a concave shape when viewed externally of the body member.

The invention extends also to a method of supporting materials in a borehole which includes inserting a plug into the borehole;

displacing the plug through approximately 900 and, in so doing deforming the plug to wedge it in the borehole; and charging the materials to be supported into the borehole so that the materials are at least partially received in a receptacle defined by the plug.

The invention is now described by way of example with reference to the accompanying diagrammatic drawings.

DETAILED DESCRIPTION OF THE DRAWINGS

Figure 1:
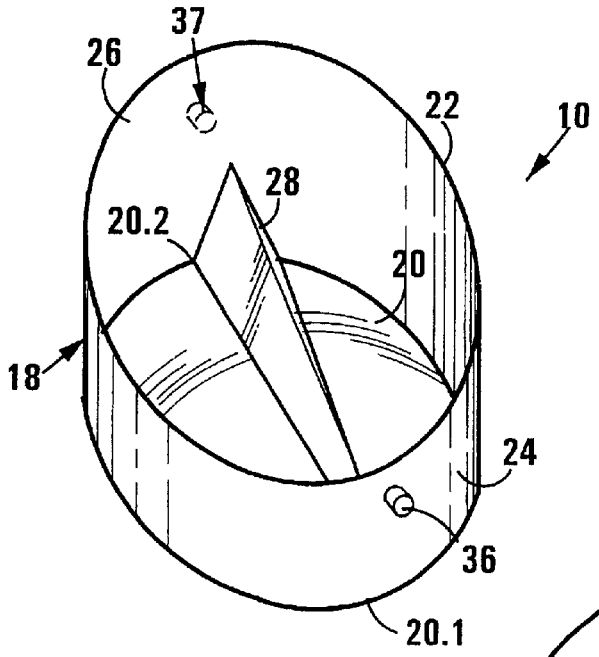
FIG. 1 shows a three dimensional view of a plug, in accordance with one embodiment of the invention, for use in a borehole.
Figure 2:
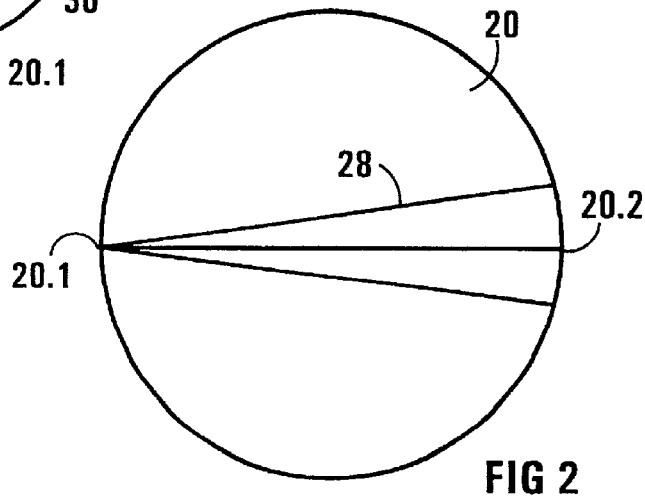
FIG. 2 shows a schematic plan view of a floor portion of the plug of FIG. 1.

Referring to the FIGS. 1 to 4, 6 and 7 of the drawings, a plug in the form of a support device, in accordance with one embodiment of the invention, for use in a borehole, is designated generally by the reference numeral 10. The device 10 is intended particularly for use in the supporting of materials in a borehole 12 (FIGS. 6 and 7) drilled substantially vertically downwardly into a substrate 14 and into which explosives 16 are charged, in use, as will be described in greater detail below.

The device 10 comprises a body member 18 of a resiliently flexible material. The resiliently flexible material from which the body member 18 is made is typically a synthetic plastics material. The body member 18 comprises a floor portion 20 which is bounded by a side wall portion 22. The thickness of the floor portion 20 may be between 0.5 mm to 30 mm. The side portion 22 extends upwardly from the floor portion 20 and flares outwardly therefrom as shown more clearly in FIG. 3 of the drawings. The angle between the side portion 22 and the floor portion 20 may be between 90° to 130°. Further, the side wall portion 22 increases in height from a front or leading end 20.1 of the floor portion 20 to a rear or trailing end 20.2 of the floor portion 20. Thus, a front part 24 of the side wall portion 22 is shorter than a rear part 26 of the side wall portion 22. It will be appreciated that the height of the highest part, being the part 26, of the side wall portion is less than a diameter of the borehole 12. Further, the floor portion 20 is substantially circular and has a diameter slightly less than the diameter of the borehole 12.

Figure 3:
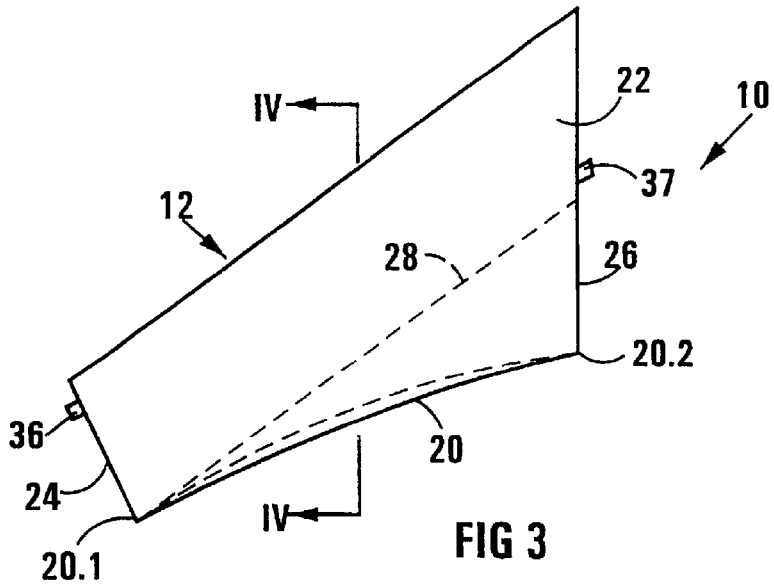
FIG. 3 shows a schematic side view of the plug of FIG. 1.

As illustrated more clearly in FIG. 3 of the drawings, the floor portion is slightly arcuate or concave. Further, to assist in deformation of the body member 18, as will be described in greater detail below, a substantially wedge-shaped groove 28 is defined in the floor portion 20 increasing in depth and width from the leading end 20.1 of the floor portion to the trailing end 20.2. The wedge-shaped groove 28 opens into an external surface of the floor portion as shown most clearly in FIG. 4 of the drawings.

Figure 4:
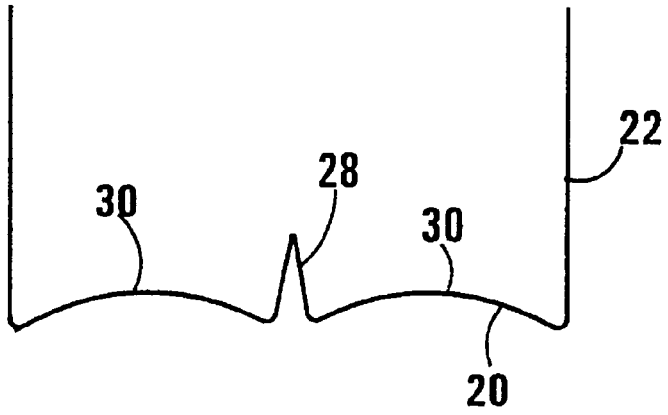
FIG. 4 shows a schematic end view taken on line IV—IV in FIG. 3.

In addition, parts 30 of the floor portion 20 on opposed sides of the groove 28 are also slightly concave, as shown in FIG. 4 of the drawings, once again to assist in deformation of the body member 18 and to assist in wedging the device 10 in the borehole 12.

Figure 5:
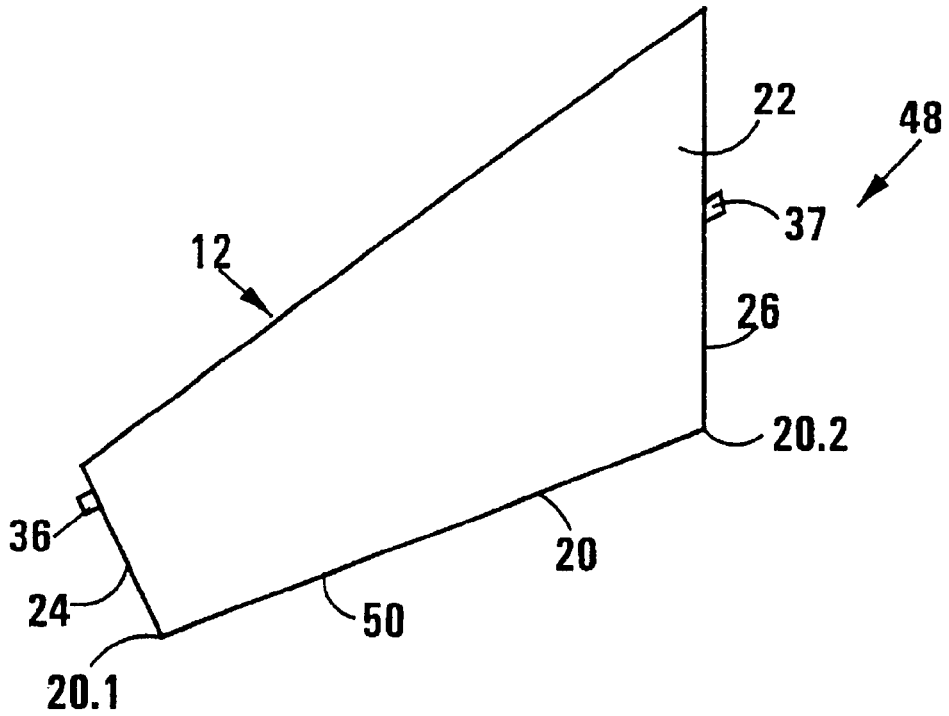
FIG. 5 shows a schematic side view of a plug, in accordance with another embodiment of the invention, for use in a borehole.

Referring now specifically to FIG. 5 of the drawings, a plug in the form of a support device, in accordance with a further embodiment of the invention, for use in a borehole, is designated generally by the reference numeral 48. In FIG. 5, like parts to that of FIGS. 1 to 4 of the drawings are indicated by like reference numerals. The plug 48 has a substantially planar floor portion 50 as shown in the drawing.

Figure 7:
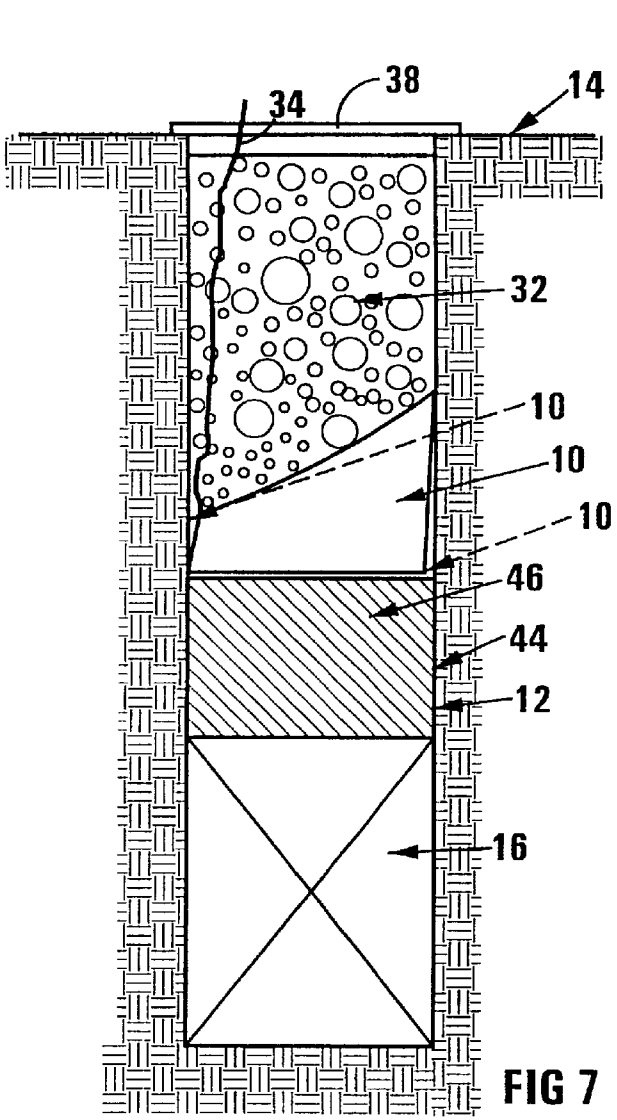
FIG. 7 shows the plug of FIG. 1 in the borehole, in use.

The device 10, as described above, is intended for use in explosives operations. Thus, the borehole 12 is drilled into the substrate 14. The explosives 16 are tamped into the borehole 12. To control the direction and nature of the explosion resulting from detonation of the explosives 16, the borehole 12 is plugged with a stemming material such as gravel 32 as shown in FIG. 7 of the drawings. To control the explosion, the gravel 32 must be contained at a predetermined distance in the borehole 12 relative to the explosives 16.

Figure 6:
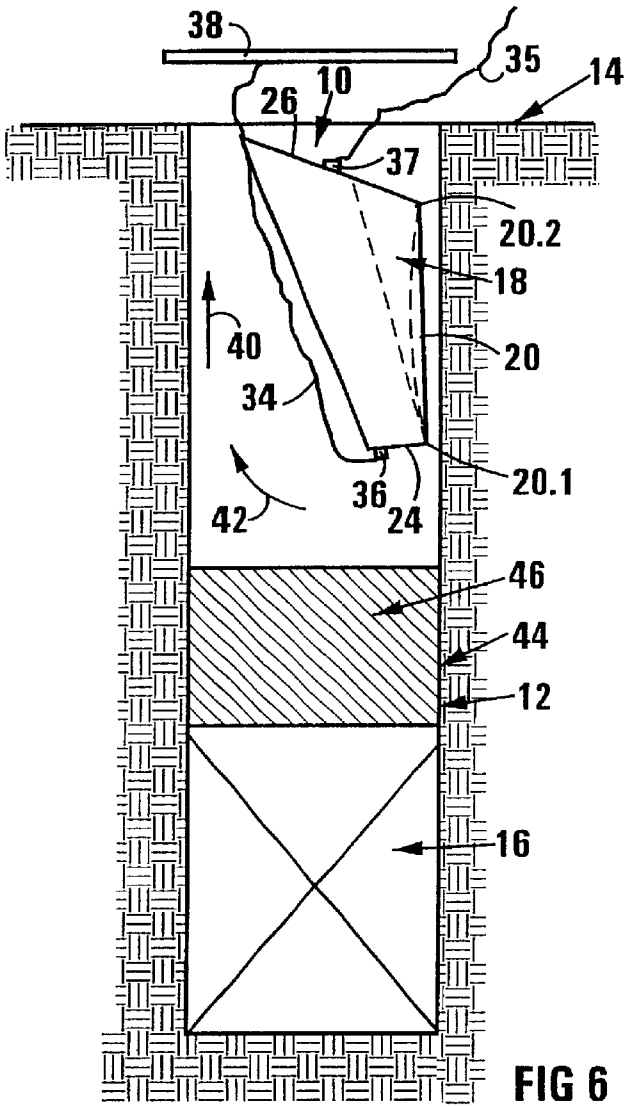
FIG. 6 shows a schematic representation of the insertion of the plug of FIG. 1 into a borehole.

For this purpose, the support device 10 is used. Thus, in use, once the borehole 12 has been charged with the explosives 16, the device 10 is inserted into the borehole as shown in FIG. 6 of the drawings. More particularly, the device 10 is inserted into the borehole 12 such that the shorter end 24 of the side wall portion 20 lies below the higher part 26 of the side wall portion 22. In other words, the device 10 is inserted into the borehole such that the leading end 20.1 of the floor portion is received in the borehole 12 ahead of the trailing end 20.2 of the floor portion 20.

To control the positioning of the device 10 within the borehole 12, a manipulating means in the form of a length of string 34 is attached to an attachment opening 36 defined in the shorter end 24 of the side wall portion 22 of the body member 18.

Thus, one end of the length of string 34 is secured in the opening 36 and an opposed end of the length of string 34 is attached to a securing means or retaining means in the form of an anchor 38. The string 34 is of a predetermined length to locate the support device 10 in the required position in the borehole 12. Thus, once the device 10 has been lowered to the required depth in the borehole 12, the string 34 is pulled upwardly in the direction of arrow 40 to rotate the device 10 in the direction of arrow 42. When this occurs, the shape of the device, more particularly, the flared side wall portion 22 causes the device 10 to wedge in the borehole 12. It will be appreciated that, as the device 10 rotates, the device 10 is deformed from the configuration shown in dotted lines in FIG. 7 of the drawings to the position shown in solid lines thereby enhancing the wedging of the device 10 in the borehole 12. The stemming or gravel 32 is then charged into the borehole to the required level. Conventionally, the device 10 is located in a spaced location relative to the explosives 16 to create a gap 44. This gap 44 can be filled with water, air or additional stemming or gravel 46. The device 10 is positioned relative to the explosive 16 so that the gap 44 is of a predetermined size thereby to control the explosion when the explosives 16 are detonated.

It will be appreciated that, instead of stemming 46, the device 10 could also be used to support a further explosive charge at an intermediate depth in the borehole 12.

A trailing end opening 37 is defined on the rear part 26 of the side wall portion 22, with a recovery means in the form of a length of string 35 being secured in the opening 37 for recovery of the body member 18 from the borehole 12, in use. It will be appreciated that when the body member 18 is lowered into the borehole 12, it may become stuck in the hole in an undesired position and the string 35 may then be used to pull the body member 18 from the borehole 12.

It is a particular advantage of the invention that a low-cost support device 10 is provided for plugging boreholes 12 and which can rapidly be installed in the boreholes 12.

What is claimed is:

1. A plug for use in a borehole, the plug including a body member of a flexible material which defines a receptacle in which material to be supported is received, the body member defining a floor portion, with a wall portion bounding and extending from the floor portion for engagement with an inner wall of the borehole for sealing the borehole, with the wall portion extending from the floor portion in a flared manner such that a rim of the wall portion bounds an opening having a greater area than that of the floor portion, wherein one end of the wall portion is lower than an opposed higher end, the lower end being a leading end and the higher end being a trailing end of the body member when it is inserted into the borehole, the body member defining an offset frusto-conical element so that an axis of the frusto-cone is at a predetermined angle to the vertical when the body member is lying on its rim which plug includes an attachment means carried by the body member for attaching a manipulating means to the body member to control its positioning within the borehole.

2. The plug as claimed in claim 1, in which the lower end and the higher end of the wall portion each extends at an angle of between 90° and 130° to the floor portion.

3. The plug as claimed in claim 1, in which at least one circumferential groove is defined in the wall portion.

4. The plug as claimed in claim 1, in which the attachment means is carried on the wall portion at said leading end of the wall portion.

5. The plug as claimed in claim 4, which the attachment means is an opening defined in said leading end of the wall portion proximate a rim of the wall portion.

6. The plug as claimed in claim 1, which includes a manipulating means in the form of an elongate, filamentary element such as a length of string which is secured to the attachment means of the body member, the string being of a predetermined length for positioning the body member at a desired location, or depth, in the borehole.

7. The plug as claimed in claim 6, which includes a securing means for securing a free end of the length of string at an entrance opening or mouth of the borehole.

8. The plug as claimed in claim 1, which includes a trailing end attachment means which is carried on the wall portion at said trailing end of the wall portion, with a recovery means in the form of a length of string being secured to the attachment means of the body member for recovery of the body member from the borehole.

9. The plug as claimed in claim 1, which includes a wedge-shaped groove which is defined in the floor portion, the wedge-shaped groove increasing in depth from the leading end of the floor portion to the trailing end to impart a cloven hoof-shape to the body member, when viewed externally of the body member.

10. A method of supporting materials in a borehole which includes inserting into the borehole a plug including a body member of a flexible material which defines a receptacle in which material to be supported is received, the body member defining a floor portion, with a wall portion bounding and extending from the floor portion for engagement with an inner wall of the borehole for sealing the borehole, with the wall portion extending from the floor portion in a flared manner such that a rim of the wall portion bounds an opening having a greater area than that of the floor portion, wherein one end of the wall portion is lower than an opposed higher end, the lower end being a leading end and the higher end being a trailing end of the body member when it is inserted into the borehole, the body member defining an offset frusto-conical element so that an axis of the frusto-cone is at a predetermined angle to the vertical when the body member is lying on its rim;

displacing the plug through approximately 90° and, in so doing deforming the plug to wedge it in the borehole; and charging the materials to be supported into the borehole so that the materials are at least partially received in a receptacle defined by the plug.

* * * * *